US007740438B2

(12) United States Patent
Xiang et al.

(10) Patent No.: US 7,740,438 B2
(45) Date of Patent: Jun. 22, 2010

(54) TROLLEY AND PARKING SYSTEM USING THE SAME

(75) Inventors: Wei Xiang, Guangdong (CN); Junming Han, Guangdong (CN); Li Tan, Guangdong (CN); Kun Bao, Guangdong (CN)

(73) Assignee: China International Marine Containers (Group) Co., Ltd., Shenzhen, Guangdong (CN)

( * ) Notice: Subject to any disclaimer, the term of this patent is extended or adjusted under 35 U.S.C. 154(b) by 1033 days.

(21) Appl. No.: 10/583,513

(22) PCT Filed: Dec. 8, 2004

(86) PCT No.: PCT/CN2004/001428

§ 371 (c)(1),
(2), (4) Date: Jun. 16, 2006

(87) PCT Pub. No.: WO2005/059276

PCT Pub. Date: Jun. 30, 2005

(65) Prior Publication Data

US 2007/0098529 A1 May 3, 2007

(30) Foreign Application Priority Data

Dec. 19, 2003 (CN) ..... 2003 1 0121827

(51) Int. Cl.
*E04H 6/08* (2006.01)

(52) U.S. Cl. ..... 414/256; 414/227; 414/253; 414/259; 414/260

(58) Field of Classification Search ..... 414/253, 414/256, 259, 260, 227
See application file for complete search history.

(56) References Cited

U.S. PATENT DOCUMENTS

| | | | | | |
|---|---|---|---|---|---|
| 1,803,583 | A | * | 5/1931 | Aitken | 414/247 |
| 3,156,366 | A | * | 11/1964 | Shutt | 414/256 |
| 3,435,965 | A | * | 4/1969 | Overlach et al. | 414/259 |
| 4,413,942 | A | | 11/1983 | Roth et al. | |
| 4,971,506 | A | * | 11/1990 | Givati | 414/256 |
| 5,286,156 | A | * | 2/1994 | Ikenouchi et al. | 414/256 |
| 5,320,473 | A | * | 6/1994 | Arnold et al. | 414/253 |
| 5,851,098 | A | * | 12/1998 | Buckenauer et al. | 414/263 |
| 5,863,171 | A | * | 1/1999 | Engman | 414/256 |
| 6,702,541 | B1 | * | 3/2004 | Lee | 414/253 |
| 2008/0031711 | A1 | * | 2/2008 | Yook et al. | 414/253 |

FOREIGN PATENT DOCUMENTS

| | | |
|---|---|---|
| CN | 1145973 | 3/1997 |
| CN | 2359398 | 1/2000 |
| CN | 2516652 | 10/2002 |
| CN | 2589596 | 12/2003 |
| EP | 0 987 384 A2 | 3/2000 |
| JP | 2002327546 | 11/2002 |
| JP | 2003120066 | 4/2003 |

* cited by examiner

*Primary Examiner*—Michael S Lowe
(74) *Attorney, Agent, or Firm*—Greer, Burns & Crain, Ltd.

(57) ABSTRACT

A trolley and parking system using the trolley for transporting cars and the like. The present trolley includes a main body, capable of moving; and a clamping apparatus, having at least a first and a second moving plate and at least a pair of clamping claws. The present parking system includes a loading table, a differential table moving relative to the loading table, a trolley moving relative to the differential table, a longitudinal driving device, a power tube line transmission mechanism, and a power valve station and an electric control system thereof.

50 Claims, 11 Drawing Sheets

TROLLEY AND PARKING SYSTEM USING THE SAME

FIELD OF THE INVENTION

The present invention relates to a trolley and a parking system for cars or car chassis, and particularly to an intelligent parking system, which can clamp and lift car wheels, goods or the like in situ and perform bidirectional back and forth movements to transport and deposit or retrieve cars or the like, and can be applied in mechanical solid parking system or assembling and transferring system for cars and chassis as well as the system for loading and unloading cars or chassis in transport process by cars or containers.

BACKGROUND OF THE INVENTION

In conventional parking equipment, in-plane moving types, vertical-elevating types, and trans-elevator mechanical parking equipment of Tada Sogood Company etc., all require a transfer system. However, the transfer systems of the prior art have limitations, for example, the plate-exchanging type, i.e. the in-plane moving type parking equipment, have a low efficiency in depositing and retrieving cars; the comb-type parking equipment requires a higher parking floor, each parking place requiring a fixed comb frame, thus increasing the cost of construction. Chinese Patent No. ZL99249841.4 discloses a transporting equipment for longitudinally depositing and retrieving cars. However, this equipment can only be moved in one direction due to its complex drive mechanism. In Chinese Patents No. ZL99244696.1 and No. ZL02263871.7, a transporting equipment for longitudinally depositing and retrieving cars is disclosed. Although this equipment can realize a bidirectional back and forth movement, it has a complex drive mechanism for clamping and placing cars and requires different mechanisms for moving the drive mechanism such as a motor, a reducing gear, a hydraulic drive station for driving clamping and placing movement and a sensing control system, all of which are placed within a narrow space of the transporting equipment, causing inconvenience to its manufacture, assembly and maintenance. Furthermore, this structure requires more steps of the clamping and placing processes as well as a complex control process, causing a longer execution time. The parking system of the prior art also has disadvantages in that it is very difficult to apply a defined mechanism to deposit or retrieve cars having various wheelbases. Therefore, they cannot meet industrial production requirements.

Generally, in the transferring process of the car and car chassis manufacture, assembly and storage, either a special production line mode for transferring work or a direct manual driving mode is adopted for the transferring step. The former mode puts a higher demand on the earlier planning stage of production equipment preparation, whereas the latter is only of low production efficiency.

In the process of transporting cars or car chassis by means of cars or containers, the loading and unloading process are mostly operated by directly driving cars or car chassis, but the space for operation is narrow and requires higher driving skills, thus causing security risks and sometimes the door cannot be opened for drivers. Moreover, the methods for clamping cars or car chassis of the prior art cannot meet the requirement for depositing and retrieving cars of different wheelbases and require a manual adjustment during the clamping, thus consuming much longer time and are unable to meet the requirement of industrial production.

SUMMARY OF THE INVENTION

Accordingly, it is an object of the present invention to provide a trolley for clamping and lifting cars or car chassis of different wheelbases in situ, the clamping claws of which can be positioned flexibly and automatically to realize a clamping and lifting performance.

It is another object of the present invention to provide a parking system for cars and car chassis, which can flexibly realize, in cooperation with a loading table, a differential table and a trolley, performing an automatic positioning for wheels of the cars of different wheelbases and a bidirectional back and forth movement for parking.

To achieve these and other advantages and in accordance with the purpose of the invention, as embodied and broadly described herein, a trolley according to the present invention, comprises a main body capable of moving, provided with at least a outer track of a predetermined length on the lateral part thereof; and a clamping means, provided with at least a first and a second moving plates capable of moving along the main body, each provided with a block including a guide track of a predetermined length on a bottom surface thereof to be defined at the outer side of the outer track; and at least a pair of clamping claws, respectively disposed on each moving plate, each comprising a support, a clamping member arranged on the support, a driving wheel, fixed on the support for matching with the guide track disposed in the block of the moving plate, at least a pair of vertical moving wheels, fixed at the end of the support where disposed the driving wheel and matching with the outer track, at least a pair of positive stops, wherein the first positive stop is arranged on the bottom surface of the support for matching with the outer track, the second positive stop is arranged on the top surface of the support for matching with the block of the moving plates, and at least a power push rod for driving the first and second moving plates to generate relative movements therebetween.

In another aspect of the present invention, a parking system for transporting cars includes a loading table, a differential table capable of moving relative to the loading table, a trolley capable of moving relative to the differential table, a longitudinal driving device, a power tube line transmission mechanism, and a power valve station and electric control system thereof. The trolley comprises a main body capable of moving, provided with a pair of outer tracks of a predetermined length arranged on both laterals thereof; a clamping means, provided with two pairs of mated moving plates, each including a first and a second moving plate, capable of moving along the main body, and each moving plate provided with a pair of blocks oppositely arranged on the bottom surface thereof, each block having a guide track of a predetermined length to be defined at the outer side of the outer track; and four pairs of clamping claws, arranged on both sides of each moving plate respectively. Each clamping claw comprises a support; a clamping member, disposed on the support; a driving wheel, fixed on the support for matching with the guide track in the block of the moving plate; at least a pair of vertical moving wheels, fixed on the end of the support where disposed the driving wheel and matching with the outer track by means of an opening on the outer track; at least a pair of positive stops, wherein the first positive stop is arranged on the bottom surface of the support for matching with the outer track, and the second positive stop is arranged on the upper surface of the support for matching with the block with a guide track of the moving plate; and at least a power push rod for driving the first and second moving plates to move relative to each other.

According to the present invention, the moving plates arranged in pairs in the trolley have the clamping claws thereof to be either opened simultaneously to be in-position or opened respectively to be in-position, thereby this invention is suitable to park the car more freely, especially to clamp/lift and loose/place cars or car chassis of different wheelbases, and can avoid the friction between the car wheels and the ground.

Also, the trolley for clamping and placing car wheels is simple in structure and easy for manufacture, assembly and maintenance; has fewer steps of lifting and placing; is easy to control; costs less time to finish movements; and can save time for parking and transporting.

Also, when the trolley performs a clamping movement, since the clamping claws have formed a wedge shape, which can search the wheel center automatically just in the original place of the car or car chassis to realize the clamping and lifting, it is suitable to clamp/lift and loose/place wheels of different diameters and wheelbases. The trolley according to the invention can not only make the clamping claws suit to clamp and lift wheels of different diameters, decreasing the friction with the wheels when clamping and lifting, but also avoid the abnormal movement due to abnormal acceleration or deceleration in the process of transport, thus avoiding effectively the rolling out of the clamped cars or car chassis during the transport, so as to ensure a safety to the cars or car chassis as well as the transporting equipment.

Moreover, the parking system can deposit or retrieve and transport cars or car chassis on common construction such as a concrete base in a manner of bidirectional back and forth movement. Thus it requires less space for operation, can be applied in a large solid parking carport, and especially can reduce construction costs.

It is to be understood that both the foregoing general description and the following detailed description of the present invention are exemplary and explanatory and are intended to provide further explanation of the invention as claimed.

BRIEF DESCRIPTION OF THE DRAWINGS

These and other advantages and features of the invention will be apparent from the following detailed description of the embodiments of the present invention with reference to the accompanying drawings, in which.

DETAILED DESCRIPTION OF THE PREFERRED EMBODIMENT

Reference will now be made in detail to embodiments of the present invention, examples of which are illustrated in the accompanying drawings. Wherever possible, the same reference numbers will be used throughout the drawings to refer to the same or like parts.

Figure 1:
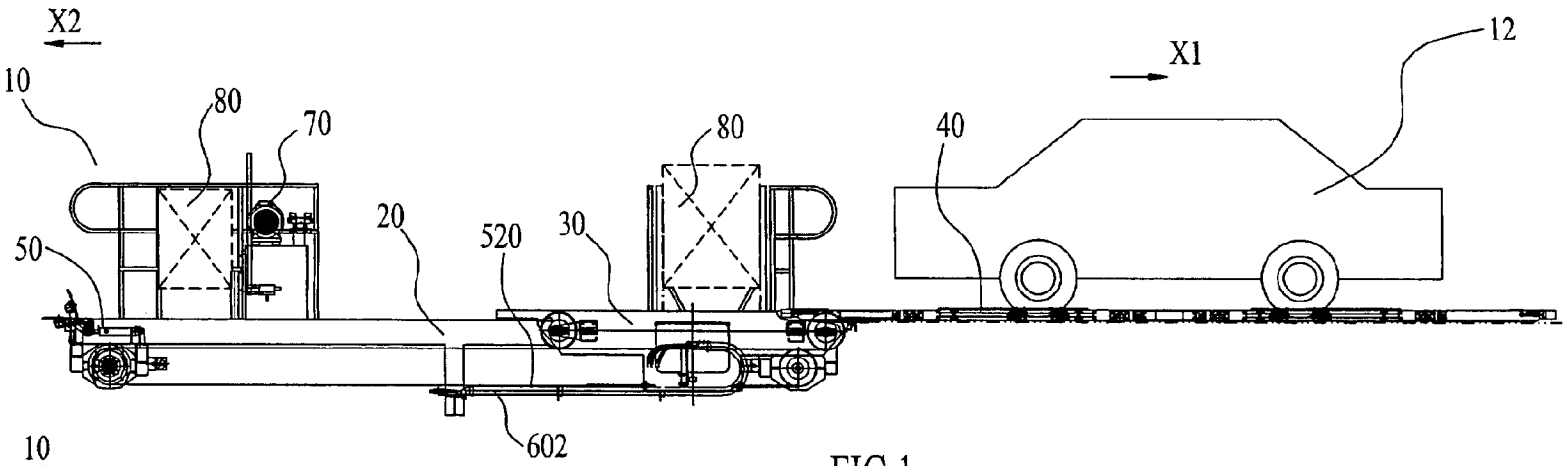
FIG. 1 is a schematic view of a parking system with a clamped car according to the present invention.

FIG. 1 is a schematic view of a parking system with a clamped car according to the present invention. Referring to FIG. 1, a parking system 10 for cars or car chassis can longitudinally transport a car 12 in the directions X1 and X2 as shown by the arrows in FIG. 1. The system 10 is necessarily equipped with a special loading table 20, a differential table 30 capable of moving relative to the loading table 20, and a trolley 40 capable of moving relative to the differential table 30. The differential table 30 can move along the longitudinal guide tracks disposed in the loading table 20, and the trolley 40 is sheathed outside the differential table 30, moving back and forth along the longitudinal direction of the differential table 30 between the front or back parking place and the loading table 20.

Figure 2:
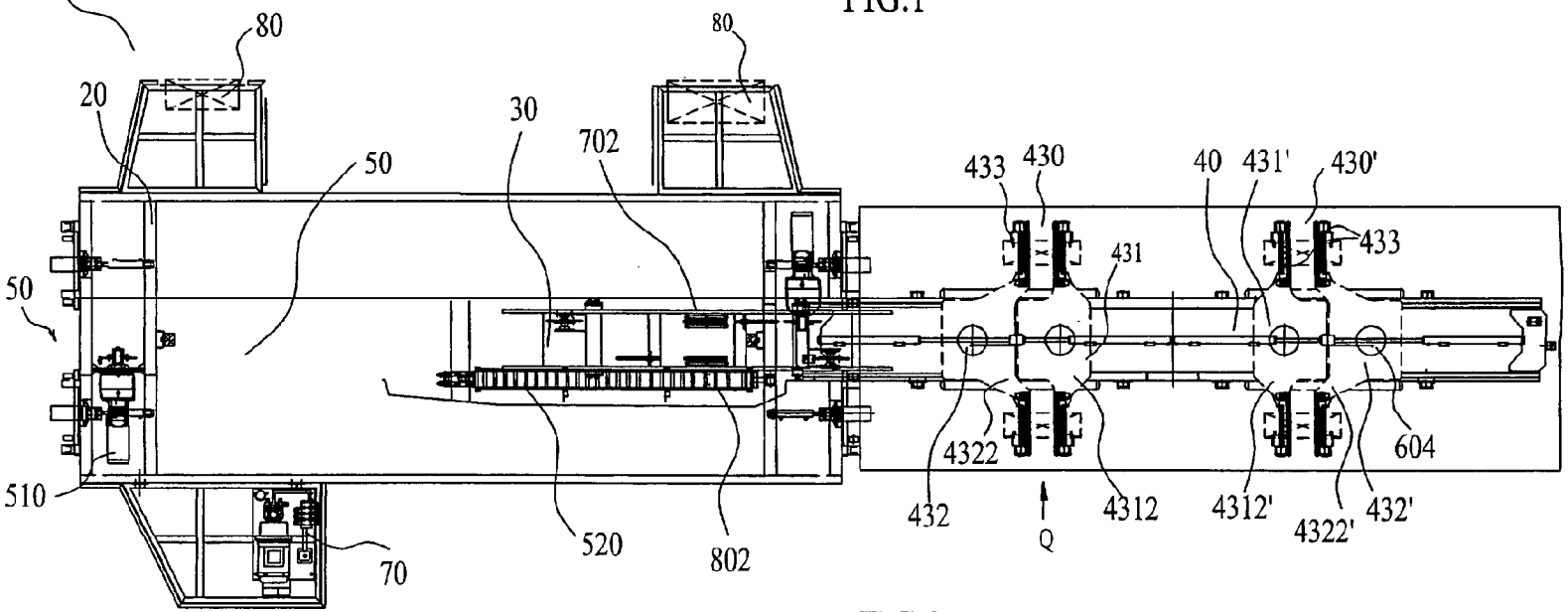
FIG. 2 is a top view of the parking system in FIG. 1 but without the clamped car, in which the dashed line represents the position of the car wheel.

FIG. 2 is a top view of the parking system in FIG. 1 but without the clamped car, in which the dashed line represents the position of the car wheel. Referring to FIG. 2, the parking system 10 further includes a longitudinal driving device 50, which outputs the powers from a reducing motor 510 through a driving chain (not shown here) to the differential table 30 and the trolley 40 in turn to generate a relative movement therebetween; a power tube line transmission mechanism 60; and a hydraulic valve station 70 and an electrical control system 80 thereof. In the present invention, the hydraulic valve station 70 and the electrical control system 80 thereof are mounted on the loading table 20 and connected with the differential table 30 by the power tube line transmission mechanism 60, and further connected with the trolley 40 through the longitudinal driving device 50. Furthermore, the longitudinal driving device 50 is controlled by the electrical control system 80 via frequency control for ensuring a stable movement of the trolley 40 and the differential table 30 and reducing the jitter of the chain.

Figure 3:
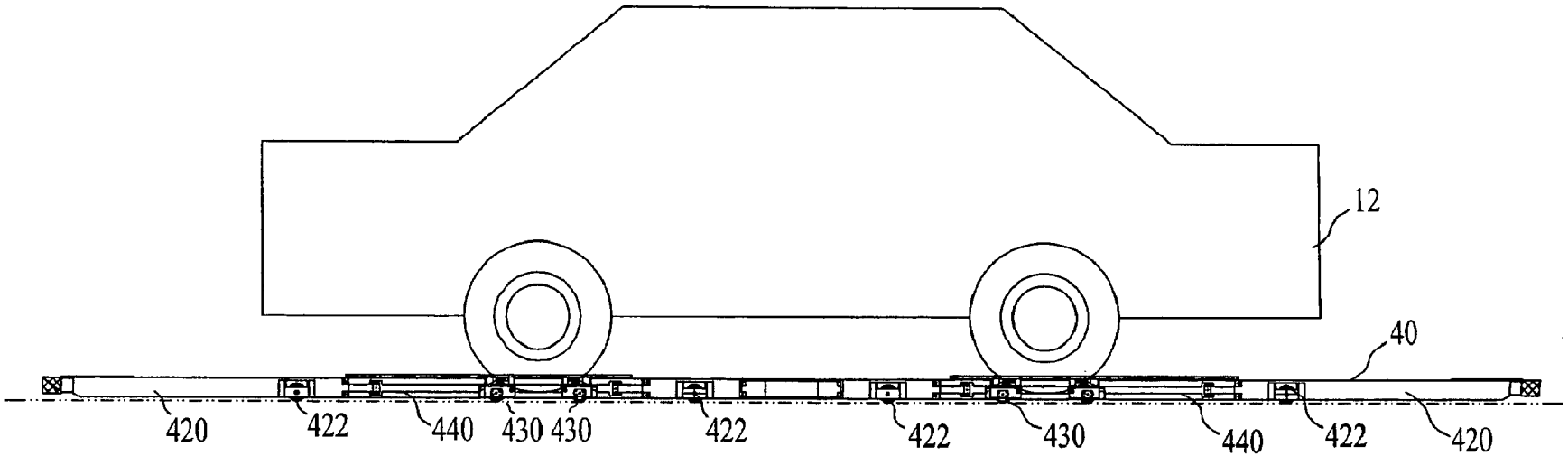
FIG. 3 is a main view of a trolley with a clamped car according to the present invention.
Figure 4:
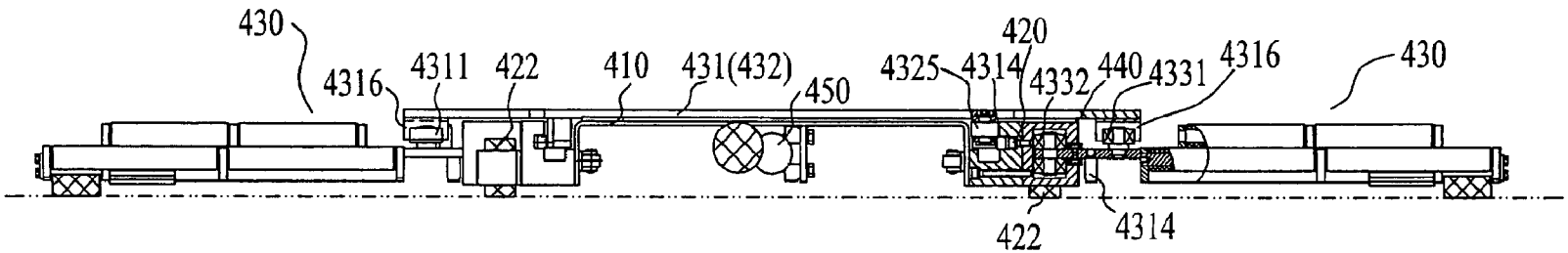
FIG. 4 is a cross-sectional view of the trolley of FIG. 3.
Figure 5A:
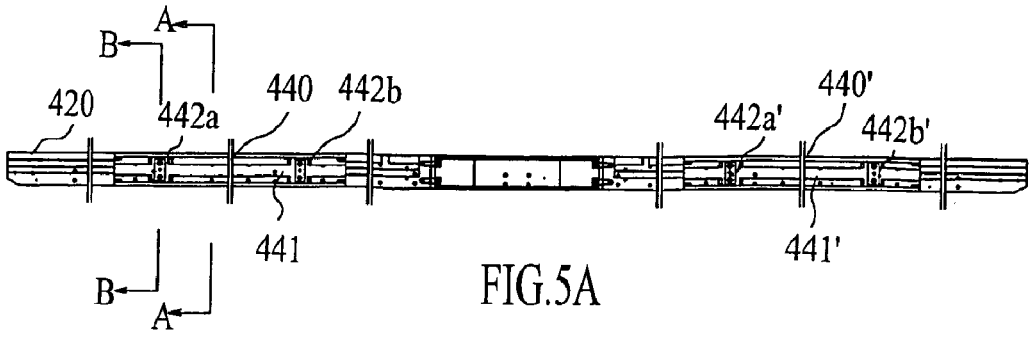
FIG. 5A is a cross-sectional view taken along the direction of the arrow Q in FIG. 2 illustrating the inner track of the trolley according to the present invention.
Figure 5B:
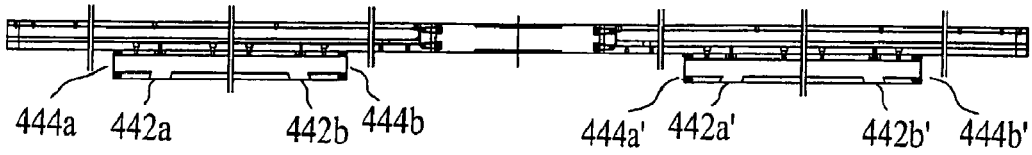
FIG. 5B is a top view of the inner track of the trolley of FIG. 5A.
Figure 5C:
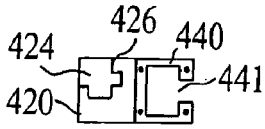
FIG. 5C is a side view of the inner track of FIG. 5A.
Figure 5D:
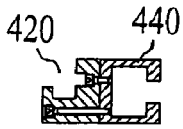
FIG. 5D is a cross-sectional view of the inner track of FIG. 5A taken along the line A-A.
Figure 5E:
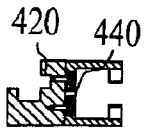
FIG. 5E is a cross-sectional view of the inner track of FIG. 5A taken along the line B-B.

FIG. 3 is a main view of a trolley with a clamped car according to the present invention, and FIG. 4 is a cross-sectional view of the trolley of FIG. 3. Referring to FIG. 3 and FIG. 4, the trolley 40 includes a main body 410 moving along a differential table 30, a clamping means 430 and a power push rod 450. Firstly, the trolley 40 is provided with an inner track 420 arranged on both laterals of the main body 410 respectively, and a plurality of moving wheels 422 are provided along the outer sides of the inner tracks 420. Specially, a pair of outer tracks 440 and 440' of predetermined length are provided on the outer side of each inner track 420, wherein each outer track 440 (440') must be staggered with the plurality of moving wheels 422. FIGS. 5A and 5B illustrate the structures of the inner track 420 and the outer track 440 (440') according to the present invention. Referring to FIGS. 5A and 5B, the outer track 440 or 440' each has a narrow through slot 441 or 441' respectively, and each has a pair of openings 442*a*, 442*b* or 442*a*', 442*b*' disposed near the both ends thereof respectively. Secondly, two arc plates 444*a* and 444*b*/444*a*' and 444*b*' are used to seal the two sides of the outer track 440/440' respectively. Preferably, as shown in FIG. 5C as a side view of the inner track, the inner track 420 has a sliding slot 424 and a guide surface 426 respectively. Furthermore, it is apparent from cross-sectional views in FIGS. 5D and 5E that the inner track 420 and the outer track 440 are fixed by fixing screws.

Referring back to FIG. 2, more particularly, the clamping means 430 includes two pairs of moving plates working in cooperation, wherein the first moving plates are represented by the reference numbers 431 and 431' respectively, and the second moving plates are represented by the reference numbers 432 and 432' respectively. Both the first and second moving plates have the wings 4312 (4312') and 4322 (4322') extending outwardly therefrom, and the wing on each moving plate must be arranged in a manner of closing to each other to meet the demand of clamping. In the present invention, the wing 4322 (4322') of the second moving plate 432 (432') extends from its inner side to the first moving plate 431 (431') to form a shape of surrounding the first moving plate. The wing 4312 (4312') of the first moving plate 431 (431') extends from its outer side to the second moving plate 432 (432').

Figure 5F:
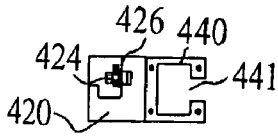
FIG. 5F is a schematic view illustrating a wheel with a flange as the sliding device of the moving plate according to the present invention to match with the inner track of FIG. 5A.
Figure 5G:
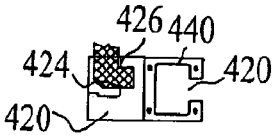
FIGS. 5G and 5H is a schematic view illustrating a sliding block as the sliding device of the moving plate to match with the inner track of FIG. 5A.
Figure 5H:
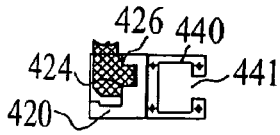
Figure 6A:
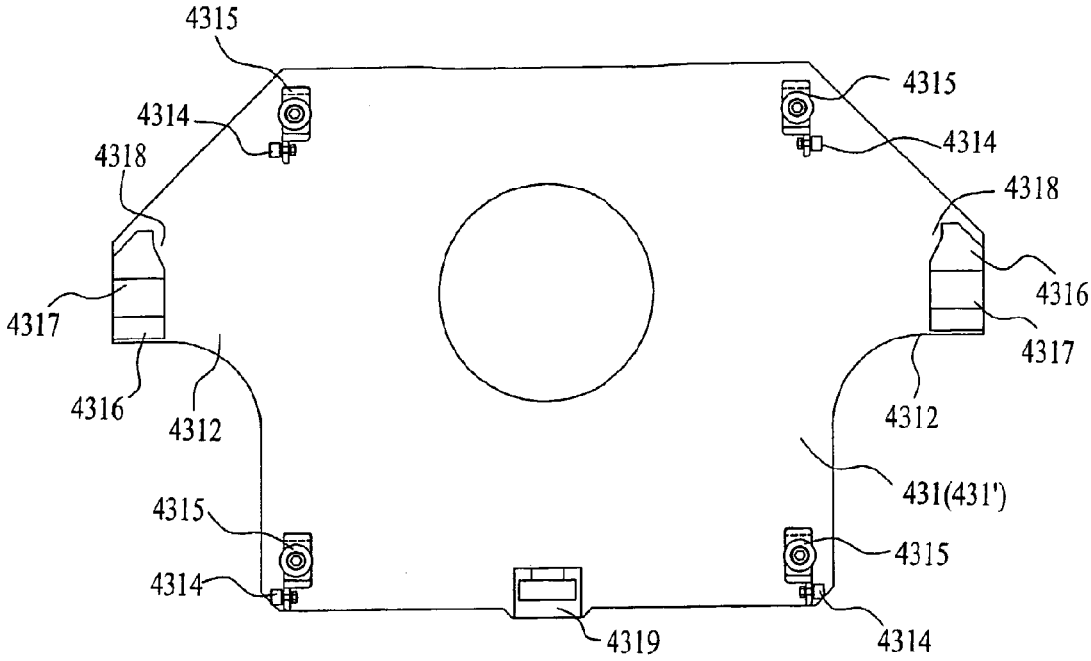
FIGS. 6A and 6B are bottom views of a pair of moving plates mating with each other according to the present invention.
Figure 6B:
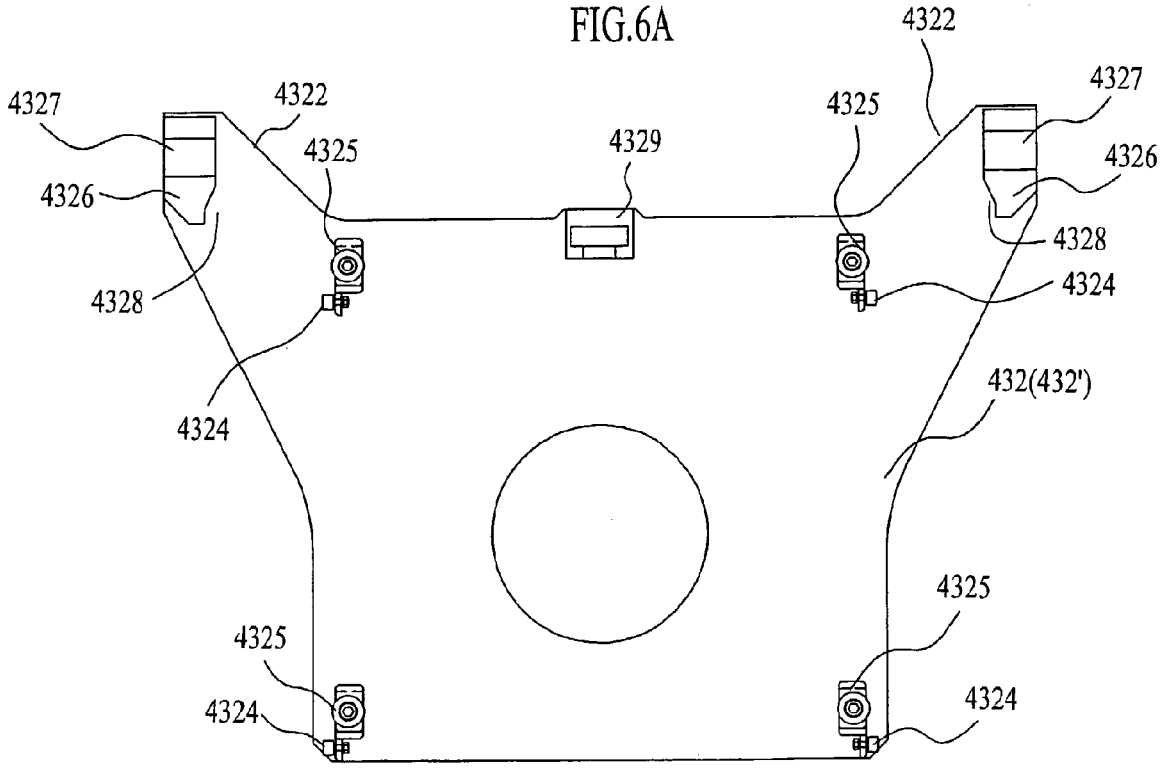

FIGS. 6A and 6B illustrate the bottom surface of the first moving plate 431 (431') and the second moving plate 432 (432') respectively. Two pairs of horizontal moving devices 4314 and 4324 are fixed on the two lateral parts of the first moving plate 431 and the second moving plate 432 respectively, which are matched with the sliding slot 424 of the inner track 420 respectively. Besides, the two lateral parts of the first moving plate 431 and the second moving plate 432 are further provided with two pairs of guide wheels 4315 and 4325 vertically arranged to match with the guide surface 426 of the inner track 420. Furthermore, the sliding devices 4314 or 4324 also can be a wheel with a flange, as shown in FIG. 5F, wherein the wheel body of the wheel matches with the sliding slot 424 of the inner track 420, and the flange of the wheel matches with the guide surface 426 of the inner track 420. Also, the sliding devices 4314 or 4324 can be a sliding block, as shown in FIGS. 5G and 5H, and the sliding block matches with the sliding slot 424 of the inner track 420. Their mechanism of movement is similar to that of the above-mentioned guide wheel, and will be not described herein therefore. Moreover, referring back to FIGS. 6A and 6B, the wings of the first or second moving plates 431 or 432 require to be provided with a block 4316 or 4326 having a guide track 4317 or 4327, respectively. Furthermore, each block requires to be provided with a stop 4318 or 4328 at the inner side of an end thereof.

Meanwhile, the first and second moving plates 431 and 432 are further connected with the power push rod 450 (as shown in FIG. 4) by a connecting seat 4319 and 4329 respectively, as shown in FIGS. 6A and 6B. Under the action of the power push rod 450, and when the first moving plate 431 and the second moving plate 432 touch each other, the two clamping claws are opened to be in-position, and at this time the power push rod 450 is not required to apply pushing force any more and will be locked in this position. Preferably, at least one of the first moving plate 431 and the second moving plate 432 is provided with a sensor thereon to detect the signals of the touch therebetween. Moreover, the power push rod 450 can be an extension oil cylinder, an electric push rod, an extension pneumatic cylinder or other power drive mechanisms.

Figure 7A:
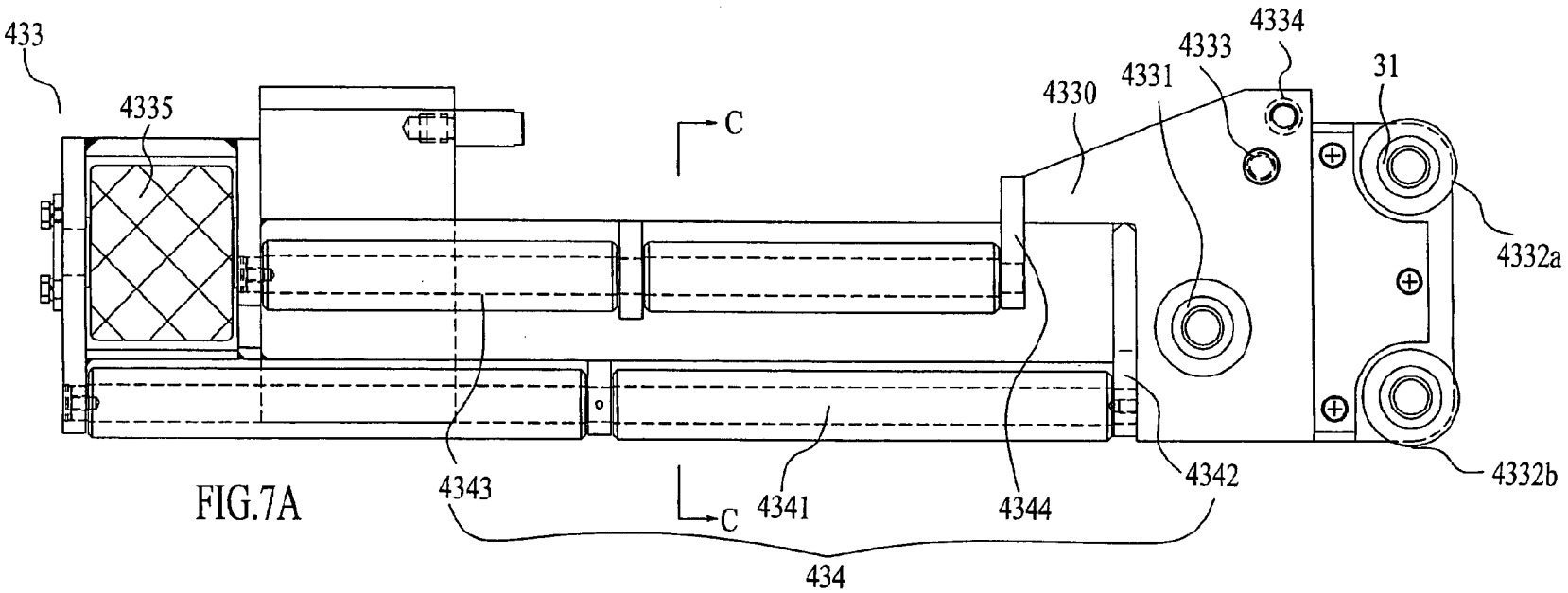
FIG. 7A is a top view of a clamping claw of the trolley according to the present invention.

FIG. 7A is a top view of a clamping claw of the trolley according to the present invention. Referring to FIG. 7A, a clamping claw 433 is further provided on both sides of each moving plate, including a support 4330, which works in cooperation with the guide track 4317/4327 in the block on the bottom surface of the moving plate by means of a driving wheel 4331 disposed near one end thereof. As the moving plate is pushed forward, the driving wheel 4331 will slide on the guide track 4317/4327.

Specially, at the end of the support 4330, the clamping claw 433 is further provided with a vertical moving wheel 4332*a* arranged near the inner side and a vertical moving wheel 4332*b* arranged near the outer side thereof respectively, wherein the vertical moving wheel 4332*a* must be always displaced in the outer track 440. Moreover, referring to FIG. 7B, a positive stop is provided as an accessory for the inner-side vertical moving wheel 4332*a*, which includes an upper positive stop 4333 and a lower positive stop 4334.

Figure 7B:
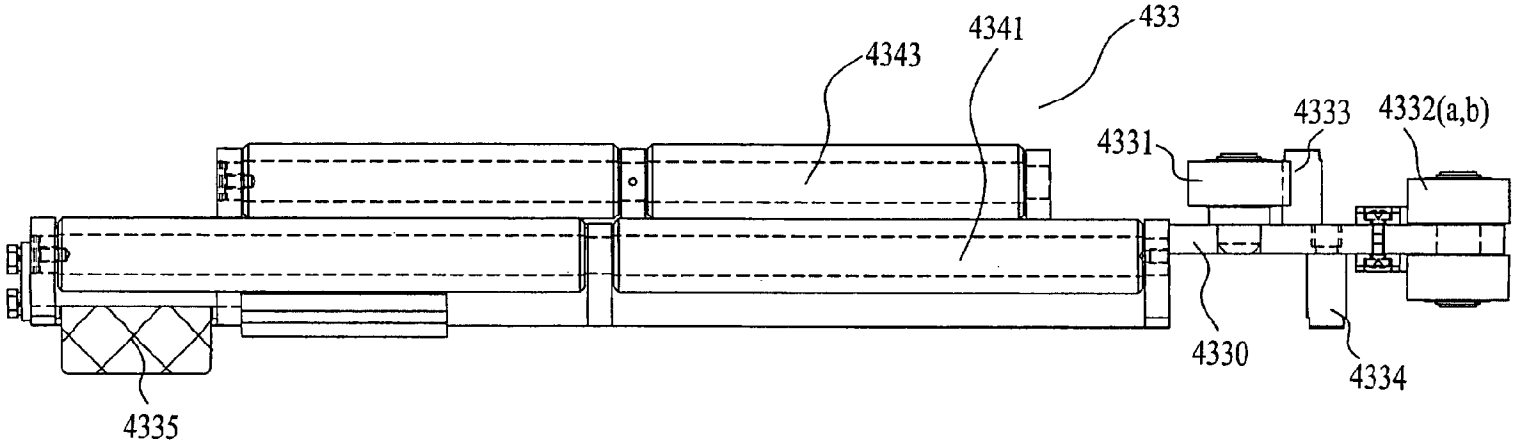
FIG. 7B is a side view of the clamping claw of FIG. 7A with upper and lower positive stops arranged thereon respectively.
Figure 7C:
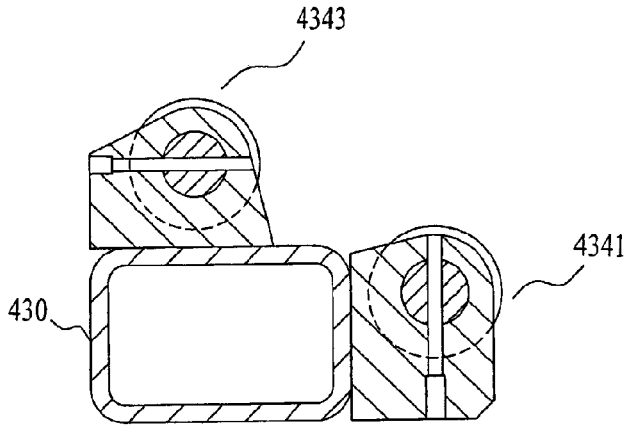
FIG. 7C is a cross-sectional view of the clamping claw taken along line C-C in FIG. 7A.
Figure 7D:
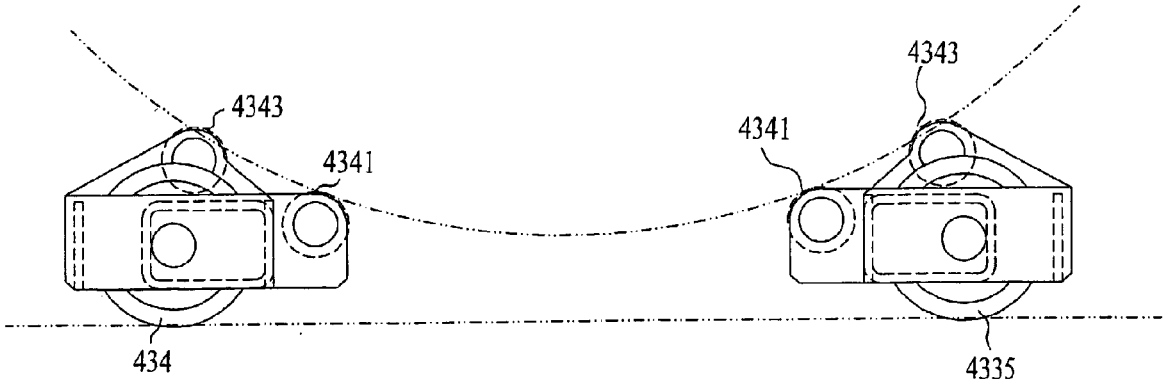
FIG. 7D is a schematic view illustrating the clamping claws of the trolley mating with each other to clamp a car wheel according to the present invention.

FIGS. 7A-7B clearly illustrate the structure of the clamping member 434, which includes a first roller set 4341 comprising at least one rotary roller (for example, two rollers, considering applications for various car wheels), the roller shaft of which (not shown) is fixed with the support 4330 by the fixing seat 4342. The clamping member 434 further includes a second roller set 4343, parallel to the first roller set 4341 and comprising at least one rotary roller fixed with the support 4330 by the fixing seat 4344, position of which must be higher than that of the first roller set 4341, as shown in FIG. 7C, with the purpose of forming a reliable wedge shape to clamp, as shown in FIG. 7D, in which arc dashed line represents the car wheel. Moreover, as a demand of the clamping action, the clamping claw 433 must be further provided with a horizontal moving wheel 4335 disposed at the other side of the support 4330, referring to FIG. 7A. The horizontal moving wheel 4335 functions: when the clamping claw 433 opens to clamp, to hold the clamping claw 433 for rotation; during the process that the car wheels are lifted and the trolley 40 transports cars or car chassis, to hold the trolley 40 to move back and forth together with a plurality of moving wheels 422 on the guide tracks. When the clamping claw 433 closes, the horizontal moving wheel 4335 dose not touch the ground any more, and not take part in holding and rolling when the trolley 40 moves.

The claw-opening process of the trolley 40 according to the present invention will now be described in detail with reference to FIGS. 8A-8D.

Figure 8A:
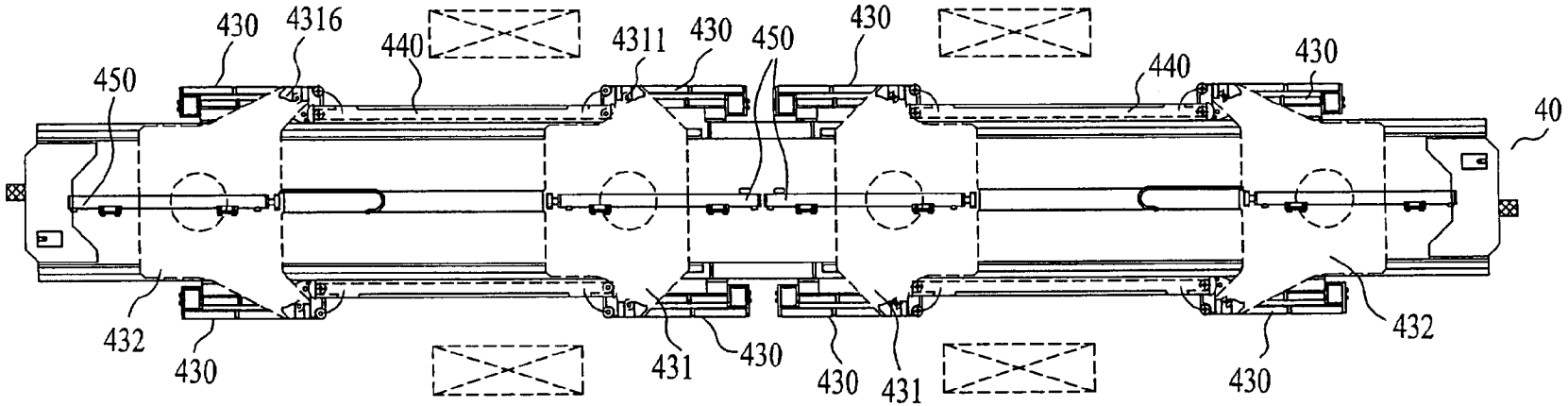
FIG. 8A is a schematic view illustrating the operation of the trolley according to the present invention with the clamping claws in a furling state.

Referring to FIG. 8A, which illustrates a start phase of the clamping operation of the trolley 40, the first moving plate 431 and the second moving plate 432 begin to move relative to each other under the action of the power push rod 450. At this time, the driving wheel 4311 drives the clamping claw 433, and the driving wheel 4311 is now at the inner side of the guide track of the block 4316. It should be understood that the wheel of the clamped car (shown by the dashed line) must be in the region aligned with the outer track 440; however, it is not important whether the wheel's position is in the middle of the stroke of the first and the second moving plates.

Figure 8B:
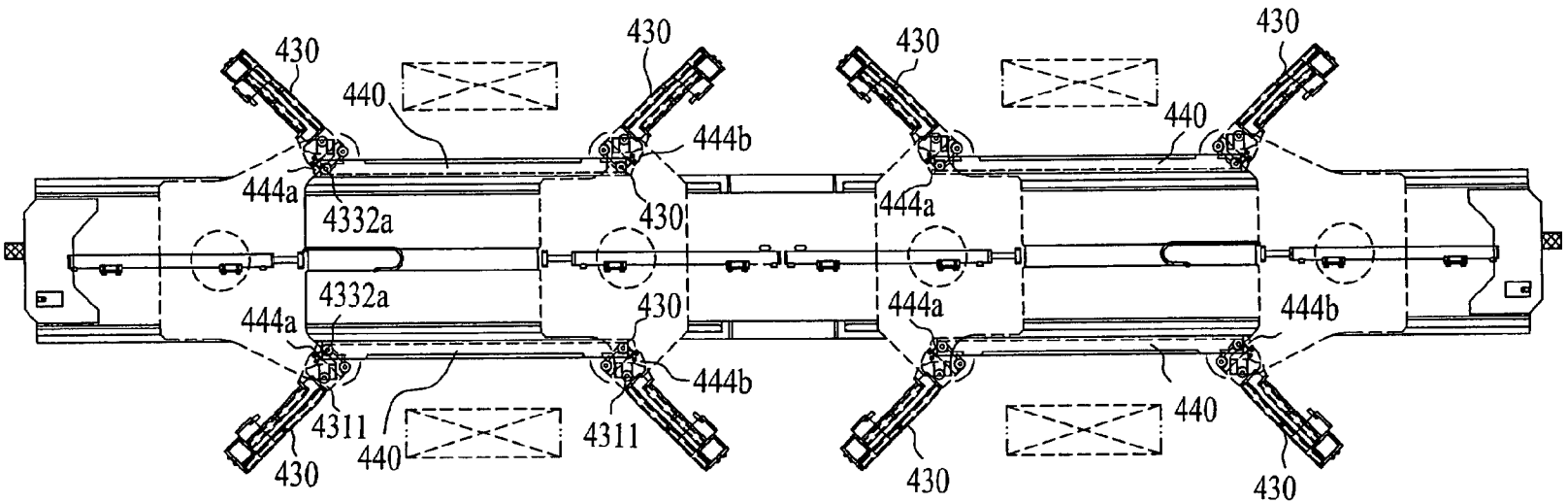
FIG. 8B is a schematic view illustrating the clamping claws in an open state by the cooperation of outer tracks after the moving plate of the trolley is actuated according to present the invention.

Referring to FIG. 8B, with the continuous relative movement of the moving plates, the driving wheel 4311 continues to drive the clamping claw 433, and the clamping claw 433 will begin to rotate pivotally in the shown direction upon the vertical moving wheel 4332*a* in the slot of the outer track 440 under the actions of the lower positive stop 4334 of the support together with the arc plates 444*a*/444*b* at both sides of the outer track 440 of the trolley 40, and meanwhile the other vertical moving wheel 4332*b* rotates into the outer track 440 through an opening, for example 442(*a*, b), at the end of the outer track 440 to perform a claw-opening movement.

Figure 8C:
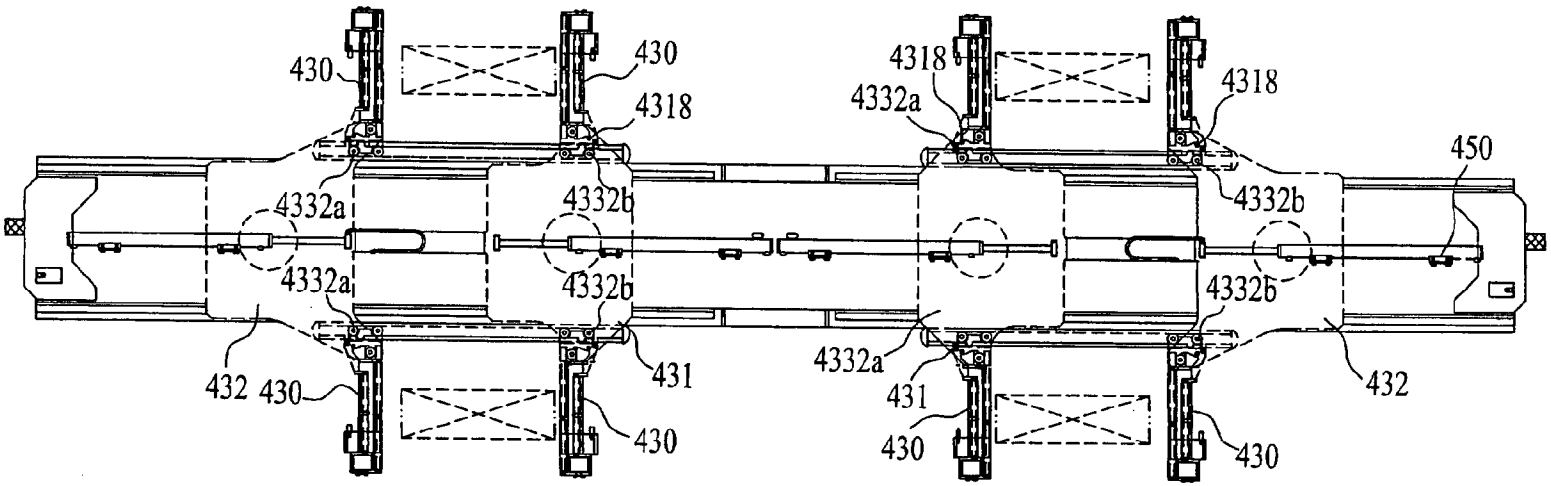
FIG. 8C is a schematic view illustrating the clamping claws of the trolley according to the present invention guided into the outer tracks.

Referring to FIG. 8C, after the claw-opening movement of the clamping claw 433, the pair of moving plates continues to move relative to each other, and drives the clamping claw 433 by the driving wheel 4331. When the vertical moving wheel 4332*a* at the inner side reaches the opening 442 of the outer track 440, the upper positive stop 4333 of the support 4330 is stopped by the stop 4318 of the block 4316, and the vertical moving wheel 4332*a* will not roll out from the stop, ensuring a reliable clamping movement. It should be understood that, if the car wheel is positioned near the end of one outer track, the vertical moving wheel 4332*a* at the inner side of the clamping means will already touch the car wheel without going through the opening 442.

Figure 8D:
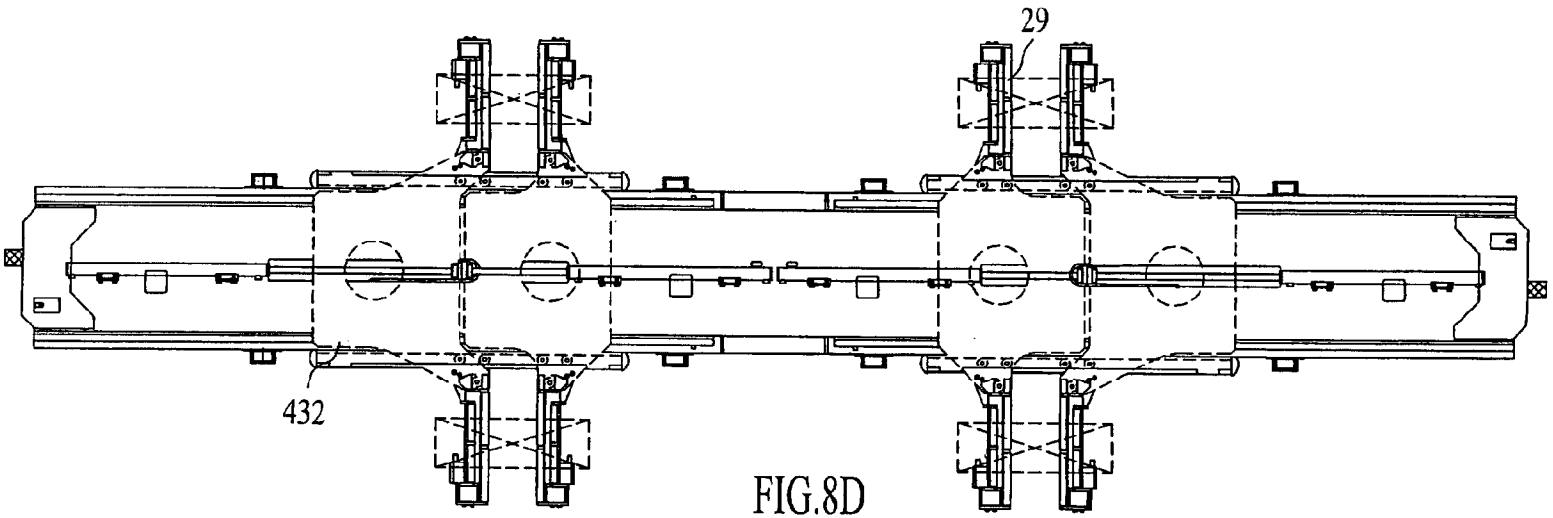
FIG. 8D is a schematic view illustrating all the clamping claws of the trolley according to the present invention in a state of opening in-position.

According to the present invention, the clamping claw 433 driven by any moving plate will stop when touching a side of the wheel. When the other clamping claw 433 driven by another moving plate also touches the side of the same wheel and after the clamping claws driven by all the four moving plates touch the wheel respectively, the driving force of the power push rod will be increased simultaneously to drive the clamping means 430 to perform a relative movement to clamp the car or car chassis wheels to be lifted off the ground. It should be noted that, according to the invention, the first moving plate and the second moving plate are designed to be driven in an equal or a similar power force, and the driving force increases gradually during the clamping process, therefore, the trolley 40 can automatically find the center of the clamped wheel for cars of different wheelbases, clamp the car at the original parking place simultaneously, and can avoid the friction of the wheel to the ground, as shown in FIG. 8D.

It should also be understood that the trolley 40 according to the present invention further has a claw-closing movement. During the process, the first and second moving plates perform a separating movement, also by driving the clamping claw 433 by the driving wheel 4331. After the vertical moving wheel 4332*a* touches the inner side of the arc plates 444 on both ends of the outer track 440 of the trolley, the clamping claw 433 rotates pivotally upon the vertical moving wheel 4332*a*, and the other vertical moving wheel 4332*b* will rotates out of the outer track of the trolley 40 through the opening 442 on the outer track 440, so as to realize a claw-closing movement. When the two clamping claws close to be in the right position, the power push rod 450 will be locked in this position without any further movement. Moreover, it is more preferable that at least one sensor is disposed between the main body 410 and each moving plate 431,432 of the trolley to detect the signals that the clamping claw has closed in right position, i.e. the clamping claw touches the main body.

Figure 9:
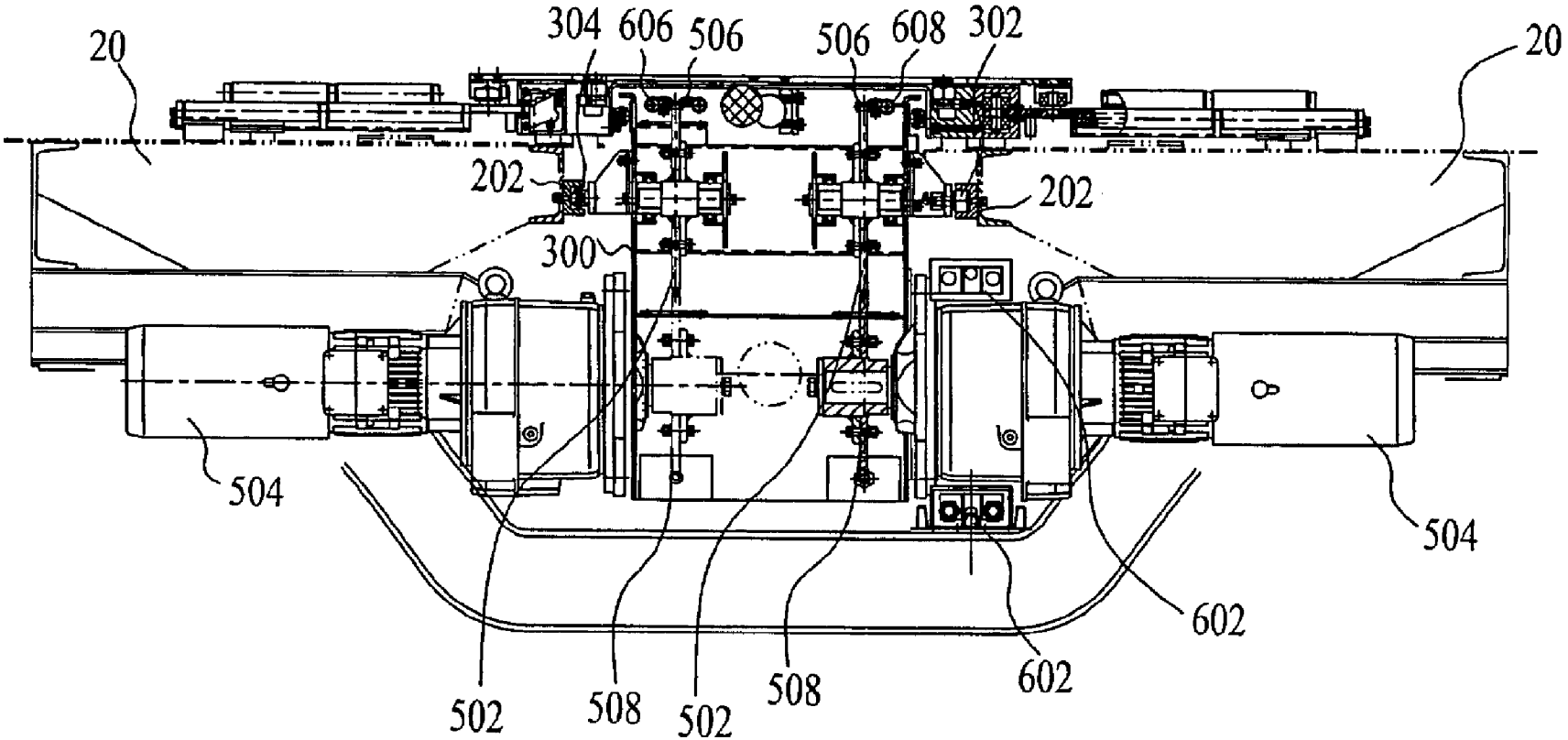
FIG. 9 is a partial cross-sectional view of the differential table according to the present invention.
Figure 10:
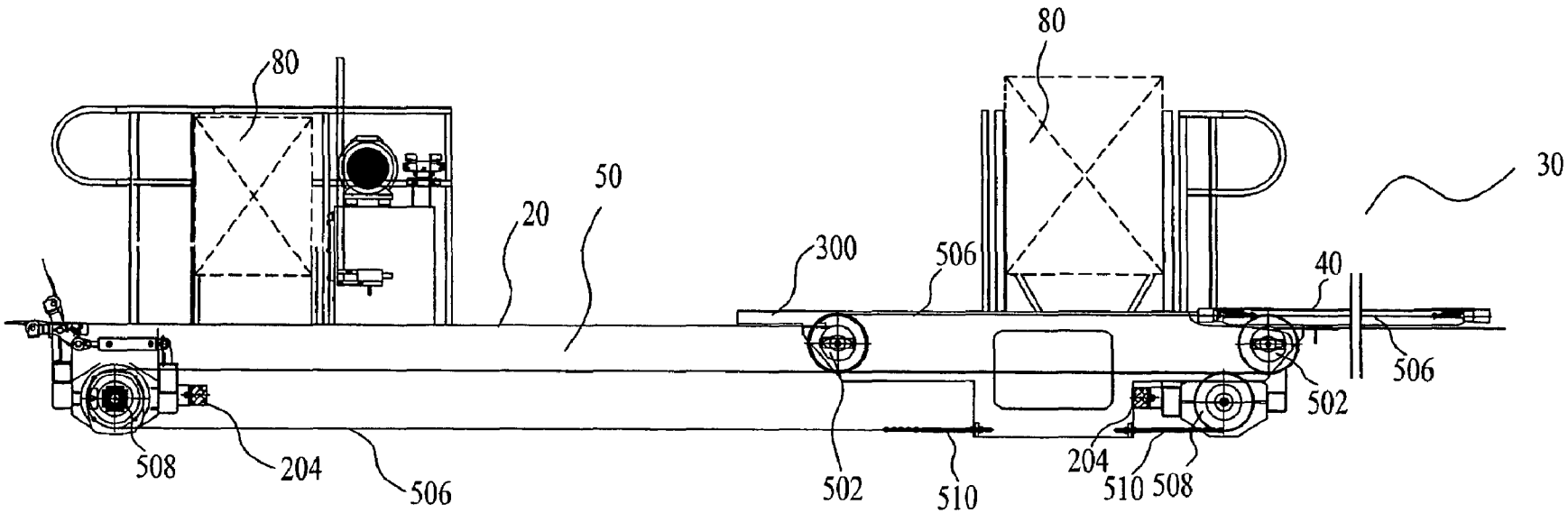
FIG. 10 shows the driving chain arranged between the loading table and the differential table according to the present invention.

FIG. 9 is a cross-sectional view of the parking system according to the present invention, wherein the differential table 30 has an inverse convex shape for matching with the driving device 50, as shown in FIG. 10. The differential table 30 mainly includes a table 300, a horizontal wheel 302 and a vertical wheel 304, and is provided with a chain roller 502 of the longitudinal driving device 50 thereon. A plurality of horizontal wheels 302 and vertical wheels 304 are disposed, sliding on a longitudinal guide track 202 of the loading table 20 to bring the differential table 30 into a linear back and forth movement.

Accordingly, the first moving plate 431 and the second moving plate 432 of the trolley 40 in the parking system according to the present invention can be guided into movement by, except guide wheels, wheels with flanges (as shown in FIG. 5F) or slide blocks (as is shown in FIG. 5G), with the movement mechanism described above and not described here again.

Moreover, the longitudinal driving device 50 is mainly comprises two reducing motors 504, two sets of driven chains 506 and two chain rollers 502 disposed on the differential table 30. The two reducing motors 504 are mounted on the left and right sides of the front and rear ends of the loading table 30 respectively, the driving shaft of which is provided with a chain roller 508 thereon. Accordingly, the two sets of driven chains 506 and the two chain rollers 502 are also disposed on left and right side respectively. One fixing seat of the left/right driven chains 506 is fixed with both the front and rear end of the trolley 40 respectively, and the other fixing seat is connected with the differential table 30 by a bolt 510; the two sets of driven chains 506 are round the chain roller 502 and the chain roller 508 respectively, whose tightness can be adjusted by the bolt 510. The two chain rollers 502 are mounted on the differential table 30 as a driving roller. When the differential table 30 moves along the loading table 20, the trolley 40 and the differential table 30 perform a relative movement with a moving ratio of 2:1. The two reducing motors 504 are controlled in frequency-conversion to reduce the jitter of the chain during operation. The reducing motor 504 drives the driven chain 506 and the chain roller 502 simultaneously in dual-way by means of the chain roller 508 and further drives the trolley 40 and the differential table 30 to move back and forth. A mechanical buffer 204 is further provided between the loading table 20 and the differential table 30 to provide a damping and protection when the differential table 30 reaches the front or rear limiting position. A sensor for detecting speed reduction and positioning can be disposed longitudinally between the loading table 20 and the differential table 30 for detecting the position of the differential table 30, and for controlling the speed reduction and stop of the trolley 40 in the front, middle and rear positions by an electric control system 80 in frequency-conversion.

Besides, the power tube line transmission mechanism 60 mainly comprises a big towing chain mechanism 602 (referring to FIGS. 1 and 9) and a small towing chain mechanism 604 for transmitting an oil tube 702 connected with a hydraulic valve station 70 and a cable 802 connected with an electric control system 80 (referring to FIGS. 2 and 9), respectively. Returning now to FIGS. 1 and 2, the oil tube 702 of the hydraulic valve station 70 and the cable 802 of the electric control system 80 are transported to the differential table 30 through the big towing chain mechanism 602, which are further transported to the trolley 40 through the two driving chains 506 of the longitudinal driving device 50 respectively. The oil tube 702 is connected to the power push rod 450, and the control cable 802 is connected to each sensor of the trolley 40, and moreover, two sets of control cables are further transported through the small towing chain mechanism 604 to connect with the detecting sensor for detecting the signals of clamping in-position.

Figure 11:
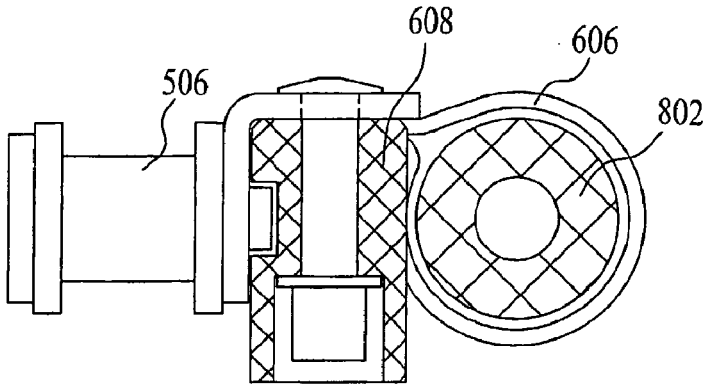
FIG. 11 is a schematic view illustrating a cable attaching on the driving chain.
Figure 12:
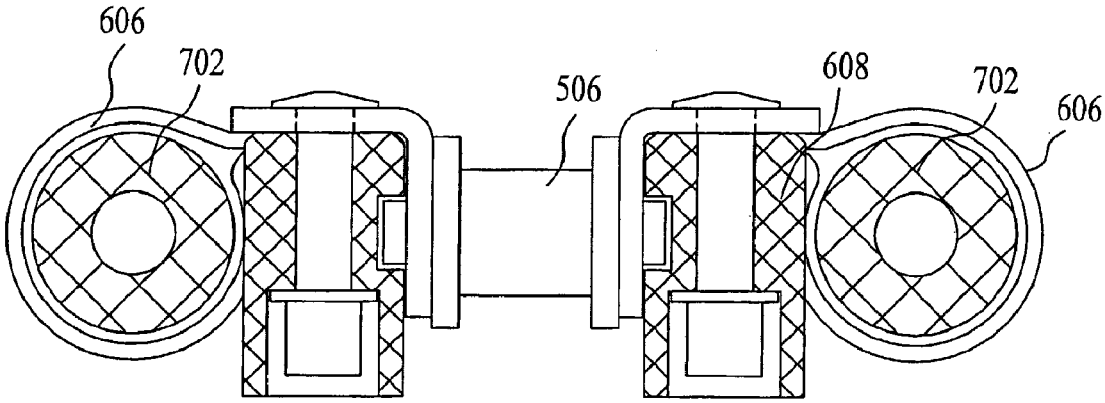
FIG. 12 is a schematic view illustrating an oil tube attaching on the driving chain.

Referring to FIG. 11, more particularly, the cable 802 is attached on the chain 506 through a connecting ring 606. And referring to FIG. 12, the oil tube 702 is directly attached on the two sides of the chain 506 through the connecting ring 606. To avoid the friction occurred directly to the ground or mechanisms caused by the oil tube 702 and the cable 802 on the chain 506, a lower sliding block 608 is arranged under the chain 506. Moreover, the chain 506 can also be provided with a plurality of tubes in accordance with the specifications for the design.

Moreover, the electric control system 7 employs the PLC technique, which makes use of the signals from the detecting sensor between the loading table 20 and the differential table 30 to control in a manner of frequency-conversion the front and rear reducing motors 510 on the longitudinal driving device 50, and further drive the two sets of chains 506 and the chain rollers 502 to bring the trolley 40 and the differential table 30 into a bidirectional back and forth movement. The detecting sensor of the trolley is used to detect the signals for claw-closing and clamping-in-position to control the movements of the hydraulic valve station 70 and the power push rod 450. And an upper computer is used to issue instructions automatically, thus realizing easily a fully automatic control.

Accordingly, the parking system 10 according to the present invention is very easy to be used to deposit or retrieve cars, wherein the control process of the electric control system 80 for retrieving cars is: first, the loading table 20 can move, by means of other mechanisms, to the parking place of the car to be retrieved; a plate-reversing mechanism (not shown) makes a bridge; then the trolley 40 moves to the parking place from the loading table 20 after receiving the signal of bridge-making-in-position (i.e. bridge being ready); and then the trolley 40 decelerates and stops by means of a detecting sensor for detecting signals of deceleration and being in-position at the front (or rear) position between the loading table 20 and the differential table 30. Then, the trolley 40 opens the claws to begin to clamp the wheels after the electric control system 80 receives the moving in-position signal of the trolley 40. And then, the trolley 40 carries the car to move to the loading table from the parking place after the electric control system 80 receives the signal of clamping in-position of all claws, and the trolley decelerates and stops in the middle of the loading table by means of the detecting sensor for detecting signals of middle-position-deceleration and in-position between the loading table and the differential table. After the electric control system 80 receives the signal of moving in-position of the trolley, the plate-reversing mechanism on the loading table 20 draws back the bridge. Finally, after the electric control system 80 receives the signal of bridge-drawing-in-position, the process of retrieving car is completed, and the loading table can transport the car to the relevant position by means of other equipment.

In another aspect, the control process for depositing cars of the electric control system 80 is: first, the loading table 20 carried with a car moves by means of other mechanisms to the parking place for depositing the car; the plate-reversing mechanism makes a bridge; then the trolley 40 carried with a car moves to the parking place from the loading table 20 after receiving the signal of bridge-making-in-position, and the car decelerates and stops by means of a detecting sensor for detecting the deceleration and stop in the front (or rear) position between the loading table 20 and the differential table 30. Then, the trolley 40 looses and closes its claw after the electric control system 80 receives the moving-in-position signal of the trolley 40. And then, the trolley 40 moves to the loading table 20 from the parking place after the electric control system 80 receives the signal of closing-in-position of all claws, and the car decelerates and stops in the middle of the loading table 20 by means of the detecting sensor for detecting signals of middle-position deceleration and in-position detection between the loading table 20 and the differential table 30. After the electric control system 80 receives the signal of moving-in-position of the trolley, the plate-reversing mechanism on the loading table 20 draws back the bridge. Finally, after the electric control system 80 receives the signal of bridge-drawing-in-position, the process of depositing car is finished, and the car is then parked on the relevant parking place.

Since the parking system according to the present invention can realize the parking and transporting cars or car chassis on common concrete ground, it can be used further as a complementary equipment for transferring. Especially in the reconstruction of production line for cars or car chassis, this invention can be applied for a flexible transferring equipment in the reconstruction.

Direct manually-driving cars or car chases is not necessary in the application of the invention, which can avoid the driving operation based on driver's experience and thus can achieve to accurately park cars or car chassis in a narrow parking space.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A trolley, comprising a main body capable of moving, provided with at least an outer track of a predetermined length on the lateral part thereof; and a clamping means, provided with at least a first and a second moving plate capable of moving along the main body, each provided with a block including a guide track of a predetermined length on a bottom surface thereof to be defined at the outer side of the outer track; and at least a pair of clamping claws, respectively disposed on each moving plate, each comprising a support;

a clamping member arranged on the support;

a driving wheel, fixed on the support for matching with the guide track disposed in the block of the moving plate;

at least a pair of vertically moving wheels, fixed at the end of the support where the driving wheel is disposed and matching with the outer track;

at least a pair of positive stops, wherein the first positive stop is arranged on the bottom surface of the support for matching with the outer track, the second positive stop is arranged on the top surface of the support for matching with the block of the moving plates; and at least a power push rod for driving the first and second moving plates to generate relative movements therebetween.

2. A trolley according to claim 1, wherein the main body further comprises at least an inner track provided with a sliding slot and a guide surface, the outer side of the inner track fixed with the outer track.

3. A trolley according to claim 2, wherein a plurality of sliding devices are fixed on both side parts of each moving plate, matching with the inner track respectively.

4. A trolley according to claim 3, wherein the sliding device of the moving plate comprises a horizontal guide wheel matched with the sliding slot of the inner track and a vertical guide wheel matched with the guide surface of the inner track.

5. A trolley according to claim 3, wherein the sliding device of the moving plate is a wheel with a flange, wherein the rolling body of the wheel matches with the sliding slot of the inner track, while the flange of the wheel matches with the guide surface of the inner track.

6. A trolley according to claim 3, wherein the sliding device of the moving plate is a sliding block matching with the sliding slot of the inner track.

7. A trolley according to claim 1, wherein the block of the moving plate is further provided with a stop disposed at the inner side of one end of the block for stopping the second positive stop.

8. A trolley according to claim 1, wherein each moving plate has at least a wing outside the outer track for arranging the block.

9. A trolley according to claim 8, wherein the wing of each moving plate is arranged in a manner of extending closely to each other.

10. A trolley according to claim 9, wherein the wing on the second moving plate extends from inside to the first moving plate and the wing of the first moving plate extends from outside to the second moving plate.

11. A trolley according to claim 1, wherein the outer track is provided with a narrow through slot for the support to pass through and a pair of openings provided at the ends thereof.

12. A trolley according to claim 11, wherein the outer track is provided with an arc plate on each end thereof.

13. A trolley according to claim 1, wherein the clamping claw comprises a horizontal moving wheel fixed at the outer end of the support.

14. A trolley according to claim 13, wherein the clamping member comprises a first roller set having at least one or more rotary rollers, a shaft of which is fixed to the support by a fixing seat.

15. A trolley according to claim 14, wherein the clamping member further comprises a second roller set having at least a rotary roller, a shaft of which is fixed to the support by a fixing seat.

16. A trolley according to claim 15, wherein the second roller set is staggered to the first roller set by arranging the shaft thereof higher than that of the first roller set to form a wedge shape with the first roller set.

17. A trolley according to claim 1, wherein each of the first and second moving plates is respectively driven by a power push rod having an end fixed on the main body and the other end connected with the respective moving plate.

18. A trolley according to claim 17, wherein the first and second moving plates are provided with at least a sensor therebetween for detecting the signals of opening-in-position of the support.

19. A trolley according to claim 17, wherein the main body and each of the first and second moving plates are provided with at least a sensor therebetween respectively for detecting the signals of closing-in-position of the support.

20. A trolley according to claim 17, wherein the power push rod drives the respective moving plate with substantially the same driving force.

21. A parking system for transporting cars, including a loading table, a differential table capable of moving relative to the loading table, a trolley capable of moving relative to the differential table, a longitudinal driving device, a power tube line transmission mechanism, and a power valve station and electric control system thereof, wherein the trolley comprises a main body capable of moving, provided with a pair of outer tracks of a predetermined length arranged on both laterals thereof;

a clamping means, provided with two pairs of mated moving plates, each including a first and a second moving plate, capable of moving along the main body, and each moving plate provided with a pair of blocks oppositely arranged on the bottom surface thereof, each block having a guide track of a predetermined length to be defined at the outer side of the outer track; and four pairs of clamping claws, arranged on both sides of each moving plate respectively, each clamping claw comprising a support;

a clamping member, disposed on the support;

a driving wheel, fixed on the support for matching with the guide track in the block of the moving plate;

at least a pair of vertically moving wheels, fixed on the end of the support where the driving wheel is disposed and matching with the outer track by means of an opening on the outer track;

at least a pair of positive stops, wherein the first positive stop is arranged on the bottom surface of the support for matching with the outer track, and the second positive stop is arranged on the upper surface of the support for matching with the block with a guide track of the moving plate; and at least a power push rod for driving the first and second moving plates to move relative to each other.

22. A parking system according to claim 21, wherein the main body is further provided with an inner track comprising a longitudinally-arranged sliding slot, the outer lateral of the inner track fixed with the outer tracks respectively.

23. A parking system according to claim 22, wherein the two lateral parts of each moving plate each have a pair of horizontal sliding devices fixed thereon to match with the sliding slots of the inner track respectively.

24. A parking system according to claim 23, wherein the inner track is further provided with a longitudinally-arranged guide surface.

25. A parking system according to claim 24, wherein each of the two lateral parts of each moving plate is further provided with a pair of vertically-arranged guide wheels to match with the guide surface.

26. A parking system according to claim 21, wherein the trolley further comprises a plurality of moving wheel sets arranged at the outer side of the inner track thereof.

27. A parking system according to claim 21, wherein the block of the moving plate is provided with a stop thereon, which is disposed on the inner side of one end of the block for stopping the second positive stop.

28. A parking system according to claim 21, wherein each moving plate has at least a wing, extending out from the outer track for arranging the block.

29. A parking system according to claim 28, wherein the wing of each moving plate is arranged in a manner of extending closely to each other.

30. A parking system according to claim 29, wherein the wing of the second moving plate extends from inside to the first moving plate, and the wing of the first moving plate extends from outside to the second moving plate.

31. A parking system according to claim 21, wherein the outer track has a narrow through slot for the support to pass through and a pair of openings arranged at the ends of the outer track.

32. A parking system according to claim 31, wherein the outer track is provided with an arc plate on each end thereof.

33. A parking system according to claim 21, wherein each clamping claw is further provided with a horizontal moving wheel at the outer lateral thereof.

34. A parking system according to claim 33, wherein the clamping member comprises a first roller set having at least a rotary roller, a shaft of which is fixed to the support by a fixing seat.

35. A parking system according to claim 34, wherein the clamping member further comprises a second roller set having at least a rotary roller, a shaft of which is fixed to the support by a fixing seat.

36. A parking system according to claim 35, wherein the second roller set is staggered to the first roller set by arranging the shaft thereof higher than that of the first roller set to form a wedge shape with the first roller set.

37. A parking system according to claim 21, wherein a pair of the first and second moving plates are driven by two power push rods respectively, each of which has one end fixed on the main body and the other end connected with the respective moving plate; while the other pair are driven by one power push rod, the two ends of which are connected with the two moving plates respectively.

38. A parking system according to claim 37, wherein each pair of the moving plates are provided with at least a sensor therebetween respectively for detecting the signals of opening-in-position of the support.

39. A parking system according to claim 37, wherein the main body and each moving plate are provided with at least a sensor therebetween respectively for detecting the signals of closing-in-position of the support.

40. A parking system according to claim 37, wherein with respect to the pair of moving plates driven by two power push rods respectively, the two power push rods drive the moving plates in a substantive same driving force, and the pair of moving plates are ensured to open in-position no later than the other pair.

41. A parking system according to claim 21, wherein the loading table is provided with a pair of longitudinal guide tracks.

42. A parking system according to claim 41, wherein the differential table has an inverse convex shape, and is provided with a plurality of sets of sliding devices respectively sliding along the longitudinal guide tracks of the loading table.

43. A parking system according to claim 42, wherein each of the sliding devices on the differential table includes at least a horizontal wheel and a vertical wheel, matching with the longitudinal guide tracks on the loading table respectively.

44. A parking system according to claim 42, wherein each of the sliding devices on the differential table is a wheel with a flange, matching with the longitudinal guide tracks on the loading table respectively.

45. A parking system according to claim 42, wherein each of the sliding devices on the differential table is a sliding block, matching with the longitudinal guide tracks on the loading table respectively.

46. A parking system according to claim 21, wherein the driving device comprises two reducing motors, disposed on the end of the loading table with a first chain roller provided on the output shaft thereof;

two chain rollers, disposed on the differential table respectively; and two sets of driving chains, crossing around the first chain roller and the chain roller disposed on the differential table respectively in such a manner that one end is fixed on the end of the trolley and the other end is fixed on the differential table.

47. A parking system according to claim 46, wherein the driving chain is fixed on the differential table by means of a bolt for adjusting the tightness of the driving chain.

48. A parking system according to claim 47, wherein the power tube line is attached to the driving chain through a connecting ring.

49. A parking system according to claim 48, wherein the driving chain is provided with a lower sliding block thereon for preventing a direct friction with the ground or other structures caused by the tube line attached on the chain.

50. A parking system according to claim 21, wherein the end of the loading table is provided with a buffer for providing damping and protection when the differential table reaches the limiting position.

* * * * *